US006447340B1

(12) United States Patent
Wu

(10) Patent No.: US 6,447,340 B1
(45) Date of Patent: Sep. 10, 2002

(54) ELECTRICAL CONNECTOR

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/930,842

(22) Filed: Aug. 15, 2001

(51) Int. Cl.[7] ..... H01R 17/00
(52) U.S. Cl. ..... 439/660; 439/924.1
(58) Field of Search ..... 439/660, 108, 439/101, 924.1

(56) References Cited

U.S. PATENT DOCUMENTS 5,993,263 A * 11/1999 Sampson ..... 439/660
6,024,608 A * 2/2000 Azuma et al. ..... 439/660
6,036,549 A * 3/2000 Wulff ..... 439/660
6,045,408 A * 4/2000 Takemasa ..... 439/660

* cited by examiner

*Primary Examiner*—Gary P. Paumen
(74) *Attorney, Agent, or Firm*—Wei Te Chung

(57) ABSTRACT

An electrical connector (1) comprises an insulative housing (2) defining a number of passageways (220), and a number of contacts (3) received in the passageways. Each contact has different widths along longitudinal axis thereof for adjusting its own impedance. The housing includes a number of inwardly extending channels (224) communicating with corresponding passageways, a number of slots (222) between adjacent passageways and a number of cavities (206) each communicating with a corresponding passageway to respectively define a first clearance (226), a second clearance (208) and a third clearance (228) between each contact and the housing for adjusting the impedance of the contact.

1 Claim, 6 Drawing Sheets

ELECTRICAL CONNECTOR

BACKGROUND OF THE INVENTION

1. Field of the Invention

The present invention relates to an electrical connector and particularly to a Serial ATA (Advanced Technology Attachment) connector used in hard disk drives for signal transmission.

2. Description of Related Art

Serial ATA connectors provide a storage interface for ATAPI (Advanced Technology Attachment Packet Interface) devices and hard disk drives, which are main storage peripheral devices of computer systems. A conventional Serial ATA connector comprises an insulative housing defining a plurality of passageways arranged in a single row and a plurality of contacts snugly received in the passageways. The contacts include a plurality of signal and ground contacts. The ground contacts are longer than the signal contacts such that the ground contacts will engage with corresponding contacts of a complementary connector before the signal contacts for hot plugging. Each contact is equal in width along longitudinal axis thereof. However, when it is required that the impedance of the contact generally be 100±0.15Ω, this design has difficulty to fulfill the impedance requirement of the contact. As a result, the electric capability of the electrical connector may be adversely affected. Hence, an improved electrical connector is required to overcome the disadvantages of the related art.

SUMMARY OF THE INVENTION

Accordingly, the object of the present invention is to provide an electrical connector having contacts fulfilling the impedance requirement, thereby ensuring a better electric capability of the electrical connector.

In order to achieve the object set forth, an electrical connector of the present invention comprises an insulative housing defining a plurality of passageways therein, and a plurality of contacts received in the passageways of the housing. Each contact has different widths along longitudinal axis thereof. The housing includes a plurality of inwardly extending channels communicating with corresponding passageways, a plurality of slots between adjacent passageways and a plurality of cavities each communicating with a corresponding passageway to respectively define a first clearance, a second clearance and a third clearance between each contact and the housing. As a result, each contact is surrounded by different medium, namely the air and the plastic. Further, the impedance of the contact is in direct proportion to the dielectric coefficient of the medium surrounding the contact. Since the dielectric coefficients of the air and the plastic are different, the impedance of the contact is effectively adjusted to meet the impedance requirement. On the other hand, the impedance of the contact is inversely proportional to its width. Therefore, the unequal widths of the contact are helpful for adjusting its own impedance to match the impedance requirement. Thus, the impedance requirement of the contact and the better electric capability of the electrical connector are ensured.

Other objects, advantages and novel features of the invention will become more apparent from the following detailed description when taken in conjunction with the accompanying drawings.

DETAILED DESCRIPTION OF THE INVENTION

Figure 1:
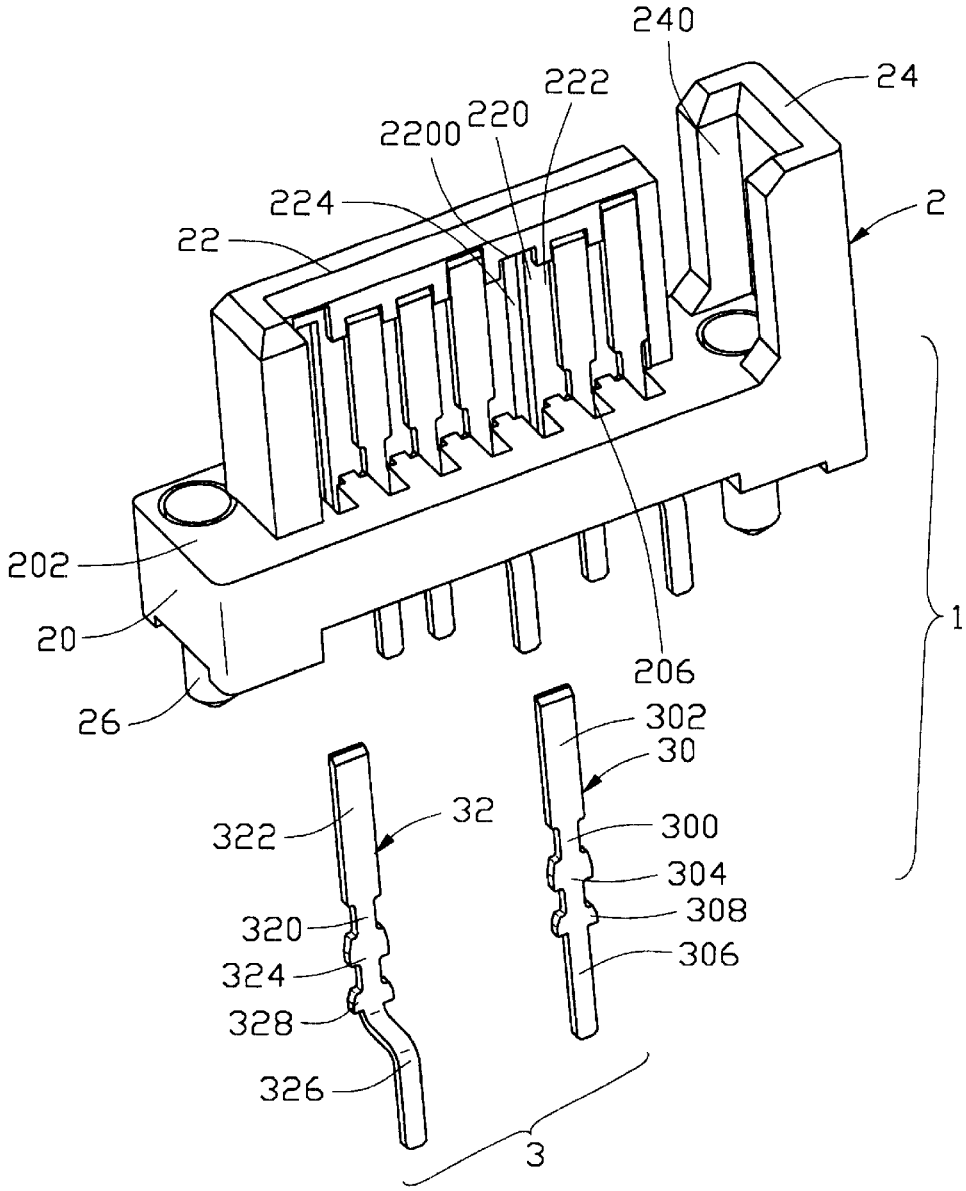
FIG. 1 is a partially exploded, perspective view of a Serial ATA connector in accordance with the present invention.
Figure 2:
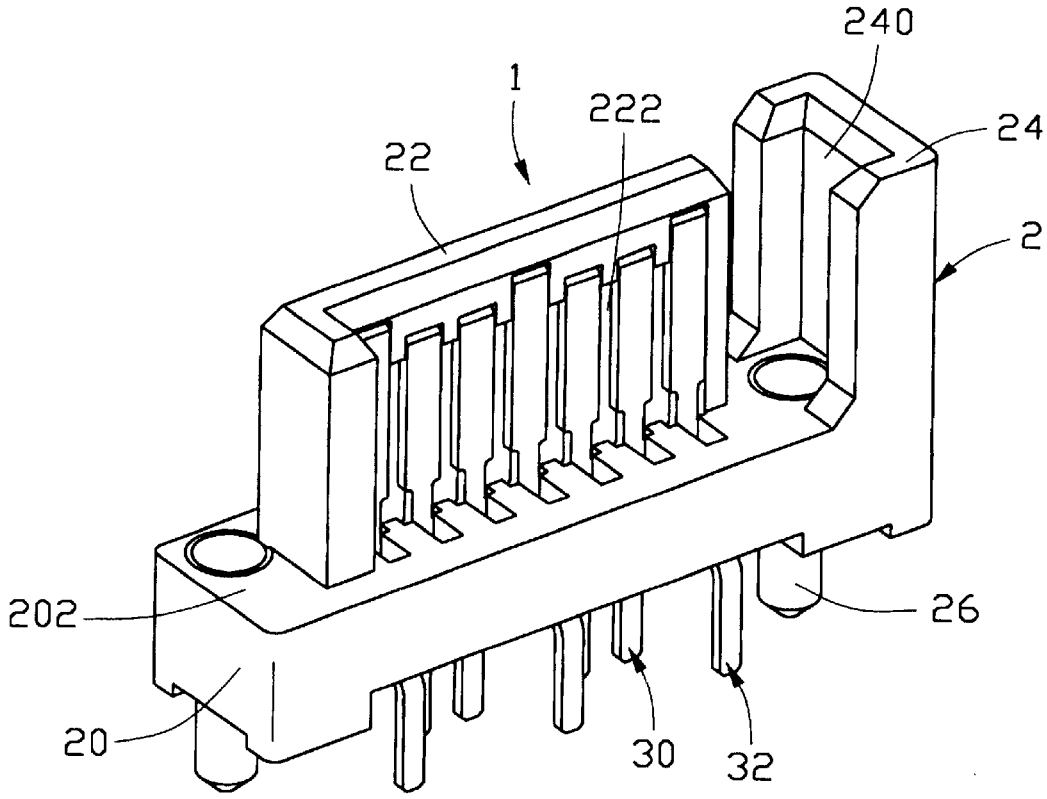
FIG. 2 is an assembled view of the connector of FIG. 1.
Figure 3:
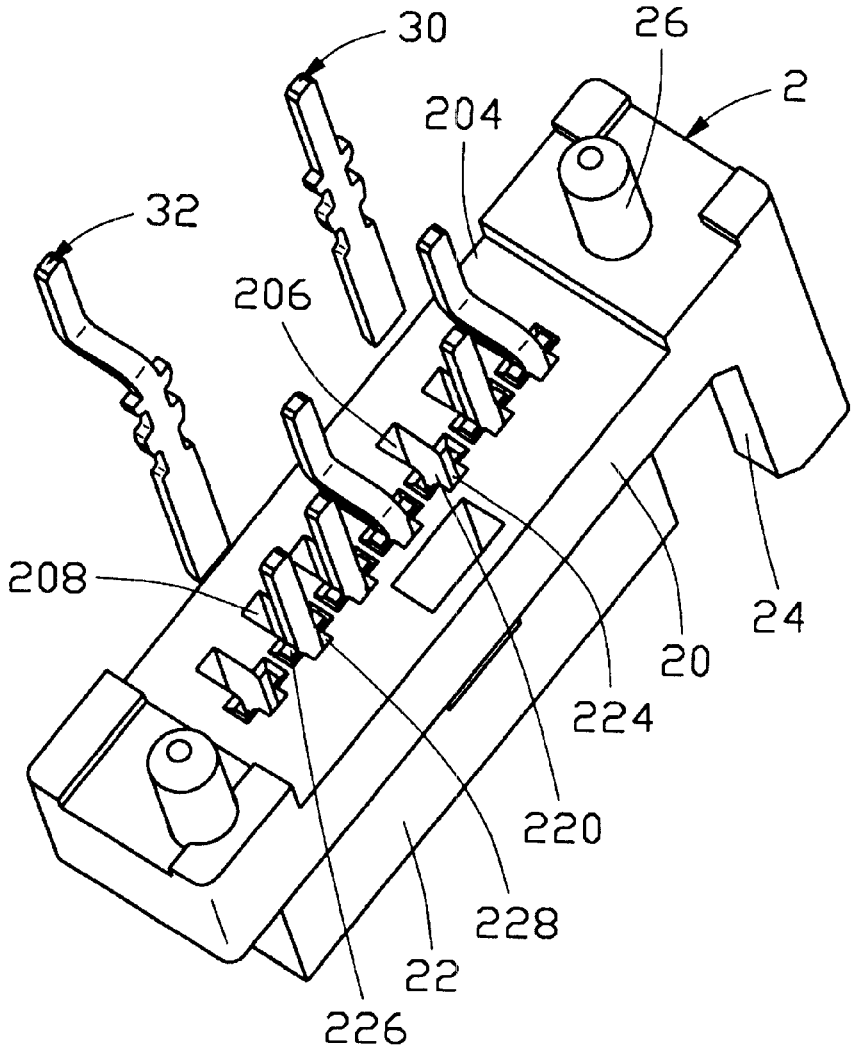
FIG. 3 is a bottom, perspective view of the connector of FIG. 1.

Referring to FIGS. 1, 2 and 3, a Serial ATA connector 1 in accordance with the present invention comprises an insulative housing 2 and a plurality of contacts 3 received in the housing 2.

The insulative housing 2 is made of plastic. The housing 2 comprises a base section 20, a mating section 22 projecting from a top surface 202 of the base section 20, and a side arm 24 upwardly extending from one end of the base section 20. The mating section 22 defines a plurality of passageways 220 extending through a bottom surface 204 of the base section 20. The passageways 220 are arranged in a single row. The side arm 24 defines a receiving channel 240 therein for receiving a corresponding alignment post of a complementary connector (not shown) to ensure a blind mating connection. The base section 20 has a pair of guiding posts 26 on opposite ends thereof and projecting beyond the bottom surface 204 for being inserted into corresponding through holes of a printed circuit board (not shown).

The mating section 22 includes a plurality of slots 222 between adjacent passageways 220 and each communicates with the adjacent passageways 220. The mating section 22 defines a plurality of inwardly extending channels 224 communicating with corresponding passageways 220 and through the bottom surface 204 of the base section 20. The base section 20 defines a plurality of cavities 206 extending from the top surface 202 to the bottom surface 204 thereof in a direction parallel to the mating section 22. Each cavity 206 communicates with a corresponding passageway 220.

The contacts 3 are received in the passageways 220 of the insulative housing 2. The contacts 3 include a plurality of signal contacts 30 and ground contacts 32. An upper portion of each ground contact 32 is nearer to a top end of the mating section 22 than an upper portion of each signal contact 30 such that, when the electrical connector 1 is engaged with the complementary connector, the ground contacts 32 will engage with corresponding contacts of the complementary connector before the signal contacts 30, thereby ensuring a hot-plug capability of the electrical connector 1. Each contact 3 is unequal in width along longitudinal axis thereof and has a narrow segment formed by stamping.

Each signal contact 30 includes a mating portion 302 received in the mating section 22 of the housing 2 for engaging with corresponding signal contacts of the complementary connector. An intermediate portion 304 integrally extends from the mating portion 302 for being received in the base section 20. A tail portion 306 integrally extends from the intermediate portion 304 and through the bottom surface 204 of the base section 20 for connection with the printed circuit board. The signal contact 30 has a narrow segment 300 formed by stamping and a broad segment 308 adjacent to the narrow segment 300.

Each ground contact 32 includes a mating portion 322 received in the mating section 22 for engaging with corresponding ground contacts of the complementary connector. An intermediate portion 324 integrally extends from the mating portion 322 for being received in the base section 20.

A tail portion 326 extends from the intermediate portion 324 at a predetermined angle thereto for connection with the printed circuit board. The ground contact 32 has a narrow segment 320 formed by stamping and a broad segment 328 adjacent to the narrow segment 320.

Figure 4:
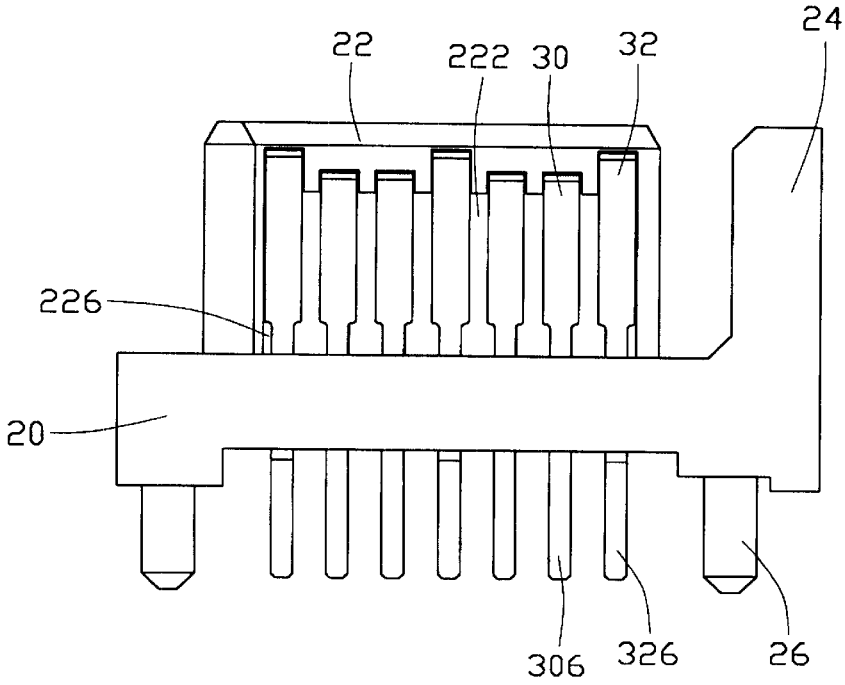
FIG. 4 is a front, plan view of the connector of FIG. 2.
Figure 5:
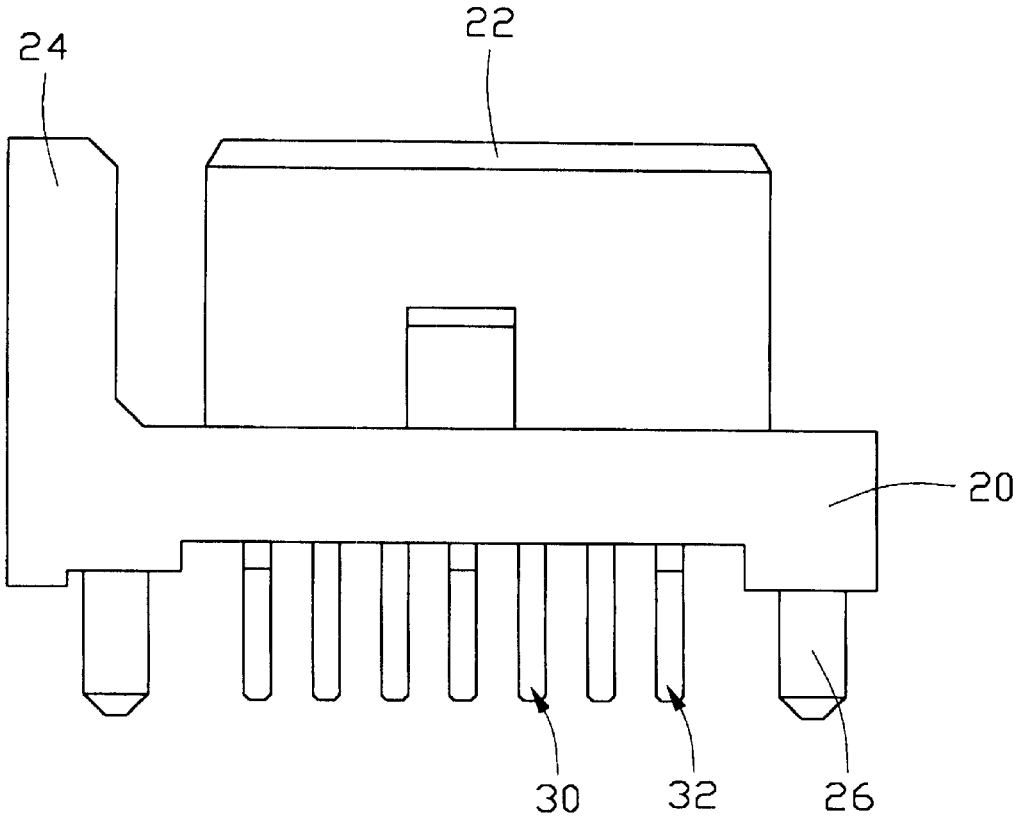
FIG. 5 is a rear, plan view of the connector of FIG. 2.
Figure 6:
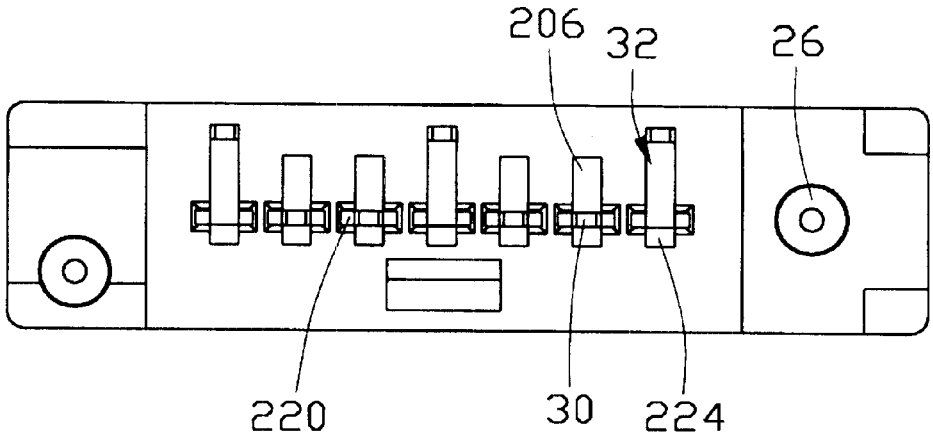
FIG. 6 is a bottom, plan view of the connector of FIG. 2.

In assembly, the contacts 3 are inserted into the passageways 220 of the housing 2 from the bottom surface 204 of the base section 20 until a top tip of each contact 3 abuts against a top surface 2200 of the corresponding passageway 220 for preventing the contacts 3 from flexing. Further, the broad segments 308, 328 of the contacts 3 function as barbs for securing the contacts 3 to the housing 2. Further referring to FIGS. 4, 5 and 6 in conjunction with FIGS. 1–3, there exists a first clearance 226 (best shown in FIG. 4) provided by a corresponding passageway 220 on opposite sides of the narrow segment 300, 320 of the contact 3. The adjacent contacts 3 are separated by a corresponding slot 222. There exists a second clearance 208 provided by a corresponding cavity 206 between the intermediate portion 304, 324 of the contact 3 and the housing 2. There also exists a third clearance 228 provided by a corresponding channel 224 between the contact 3 and the housing 2.

The clearances 226, 208, 228 as above-described are filled with air. The slot 222 between the adjacent contacts 3 is also filled with air. Thus, the contact 3 is surrounded by different medium, namely the air and the plastic. As is known, the impedance of the contact is in direct proportion to the dielectric coefficient of the medium surrounding the contact. Since the dielectric coefficients of the air and the plastic are different, the impedance of the contact 3 is effectively adjusted to meet the impedance requirement, which generally is 100±0.15Ω. On the other hand, the impedance of the contact is inversely proportional to its width. Therefore, the unequal width of each contact 3 is helpful for adjusting its own impedance to match the impedance requirement, which generally is 100±0.15Ω. Thus, the impedance requirement of the contact 3 and the preferable electric capability of the electrical connector 1 are ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of passageways; and a plurality of contacts received in the passageways of the housing, each contact having different widths along the longitudinal axis thereof;

wherein the housing includes a plurality of channels communicating with the corresponding passageways, a plurality of slots between adjacent passageways and a plurality of cavities each communicating with a corresponding passageway to respectively define a first clearance, a second clearance and a third clearance between each contact and the housing, the second and third clearances each being filled with air;

wherein the insulative housing comprises a base section and a mating section projection from the base section, and wherein the passageways are arranged in a single row and extend from the mating section to a bottom surface of the base section, the slots being defined in the mating section;

wherein the contact has a narrow segment, and the first clearance is provided by a corresponding passageway on opposite sides of each narrow segment;

wherein the cavities are defined in the base section in a direction parallel to the mating section, and the second clearance is provided by a corresponding cavity between the insulative housing and the contact;

wherein the channel extends from the mating section to the bottom surface of the base section and is recessed into the housing, and the third clearance is provided by a corresponding channel between the insulative housing and the contact;

wherein the contacts include a plurality of signal and ground contacts, an upper portion of each ground contact being nearer to a top end of the mating section than an upper portion of each signal contact.

* * * * *